US007219388B2

(12) United States Patent
Hale

(10) Patent No.: US 7,219,388 B2
(45) Date of Patent: May 22, 2007

(54) MULTI-PURPOSE CLEANING SLEEVE WITH FLAP

(76) Inventor: Daniel D. Hale, 12841 Longden St., Garden Grove, CA (US) 92841

( * ) Notice: Subject to any disclaimer, the term of this patent is extended or adjusted under 35 U.S.C. 154(b) by 0 days.

(21) Appl. No.: 10/847,118

(22) Filed: May 17, 2004

(65) Prior Publication Data

US 2004/0211019 A1 Oct. 28, 2004

Related U.S. Application Data

(63) Continuation-in-part of application No. 10/188,728, filed on Jul. 2, 2002, now abandoned.

(51) Int. Cl.
*A47L 13/16* (2006.01)
*A47L 25/00* (2006.01)

(52) U.S. Cl. ..... 15/209.1; 15/210.1

(58) Field of Classification Search ..... 15/209.1, 15/210.1, 227; 150/160; D6/608
See application file for complete search history.

(56) References Cited

U.S. PATENT DOCUMENTS 2,942,442 A * 6/1960 Egbert ..... 66/174
4,154,542 A * 5/1979 Rasmason ..... 401/7
4,403,366 A * 9/1983 Lucke ..... 15/209.1
4,510,640 A * 4/1985 Omori ..... 15/104.002
4,667,716 A * 5/1987 Solheim et al. ..... 150/160
4,893,955 A * 1/1990 Zielinski ..... 401/7
5,147,703 A * 9/1992 Provost et al. ..... 428/82
D385,742 S * 11/1997 Bird ..... D6/608
5,761,761 A * 6/1998 An ..... 15/209.1
5,770,284 A * 6/1998 Logemann ..... 428/36.1
5,813,080 A * 9/1998 Hendren ..... 15/209.1
5,918,341 A * 7/1999 Hale ..... 15/209.1
6,108,855 A * 8/2000 DeLeon ..... 15/209.1
6,175,964 B1 * 1/2001 Adler ..... 2/207
D479,292 S * 9/2003 Bergling-Olson ..... D21/754

* cited by examiner

*Primary Examiner*—Randall Chin

(57) ABSTRACT

The present invention is a multi-purpose wiping, cleaning, or polishing device that made from a soft absorbent material such as terry cloth. The device is substantially the form of a sleeve with two open ends. One or both of the open ends of the sleeve has a flap that has a longer section than an adjacent section of the end of the sleeve. The flap enables the user to easily insert an item to be cleaned while holding the multi-purpose cleaning sleeve with flap in the other hand. The dirt and debris that has been removed from the equipment remains on the inside of the sleeve and the outside of the sleeve remains clean. The outside of the sleeve can than be used for personal grooming of the face or hands, etc. without contacting the contaminated inner part of the sleeve towel.

21 Claims, 4 Drawing Sheets

MULTI-PURPOSE CLEANING SLEEVE WITH FLAP

This application is a continuation in part of application Ser. No. 10/188,728 filed on Jul. 2, 2002 now abandoned.

FIELD OF THE INVENTION

This invention relates generally to the field of sports and cleaning and maintenance devices where wiping, and/or cleaning, and/or polishing of equipment and/or hands and/or face, etc. is performed.

DESCRIPTION OF PRIOR ART

When playing golf or during other activities there are numerous occasions where it may be desirable to remove dirt and debris from golf clubs or other equipment. There is also a need to wipe perspiration and other materials from a person's hand, face and other body parts. A separate towel could be used for personal grooming and separate towel could be used for equipment cleaning. However, it would be desirable to provide a single device that would be easily use and easy to keep separate surfaces for equipment cleaning and separate surfaces for personal grooming. Additionally it would be desirable to provide a cleaning device that would enable to quickly and easily insert the equipment to be cleaned.

There have been many patented cleaning devices.

E. M. Cohen, et al, Des. 96,899, is for a Textile fabric or Other article of Manufacture.

J. K. Wetherby, U.S. Pat. No. 2,968,825, is for a Golf Ball Cleaner.

W. L. Walker, U.S. Pat. No. 3,169,264, is for a Multi-Purpose cleaning and Washing Cloth.

H. J. Trimble, U.S. Pat. No. 4,771,502, is for a towel and Method of Making Same.

R. E. Wenzel, U.S. Pat. No. 4,893,372 is for a "Free-Hand Towel."

Zeltner et al, U.S. Pat. No. 5,075,918, is for a "Combination Cleaning Towel and Carrying Case with Construction Method Therefore."

Provost et al, U.S. Pat. No. 5,147,703 is for a "Golf Towel Set."

W. Meek U.S. Pat. No. 5,394,914 is for a "Combined Wiper and Club head Cover."

K. Lang, Des. Pat. No. 355,096 is for a "Round Reach Towel."

H. An, U.S. Pat. No. 5,761,761 is for a "Tri-Section Multi-Purpose Golf Towel."

B. Beattie U.S. Pat. No. 5,898,968 is for a "Accessory for Cleaning golf Club Heads and Golf Balls."

D. Mondragon U.S. Pat. No. 5,724,698 is for a "Folded Pocket Towel."

J. English, U.S. Pat. No. 6,226,827 is for a "Golfer's Personal Cleaning Device."

These device do not provide the simplicity of use and ease of use that the disclosed device provides.

SUMMARY AND OBJECTS OF THE INVENTION

The present invention is a multi-purpose wiping, cleaning, or polishing device that made from a soft absorbent material such as terry cloth. The device is substantially the form of a sleeve with two open ends. One or both of the open ends of the sleeve has a flap that has a longer section than an adjacent section of the end of the sleeve. The flap enables the user to easily insert an item to be cleaned while holding the multi-purpose cleaning sleeve with flap in the other hand. The dirt and debris that has been removed the equipment remains on the inside of the sleeve and the outside of the sleeve remains clean. The outside of the sleeve can than be used for personal grooming of the face or hands, etc. without contacting the contaminated inner part of the sleeve towel. Also, if the multi-purpose cleaning sleeve with flap is hung from the belt of a golfer for example, the dirt and debris remains in the inner part of the multi-purpose cleaning sleeve with flap and the dirt will not rub of on the golfers cloths.

The sleeve towel could also be used in an alternate way. In this alternate application, a user would slip their hand inside the towel and use the outside for the cleaning surface. An example might be for polishing. A separate polish applicator is used to apply a polish. The sleeve-towel can be used for removing dry polish and buffing. The rubbed off polish gets built up on the outside surface. It would be desirable to keep the inside clean so the user's hand does not become soiled. Having the sleeve towel with a flap would make it very easy insert a clean hand even if the outside of the towel is soiled.

BRIEF DESCRIPTION OF THE DRAWINGS

In order that the manner in which the above and other objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying annexed drawings wherein.

Figure 1:
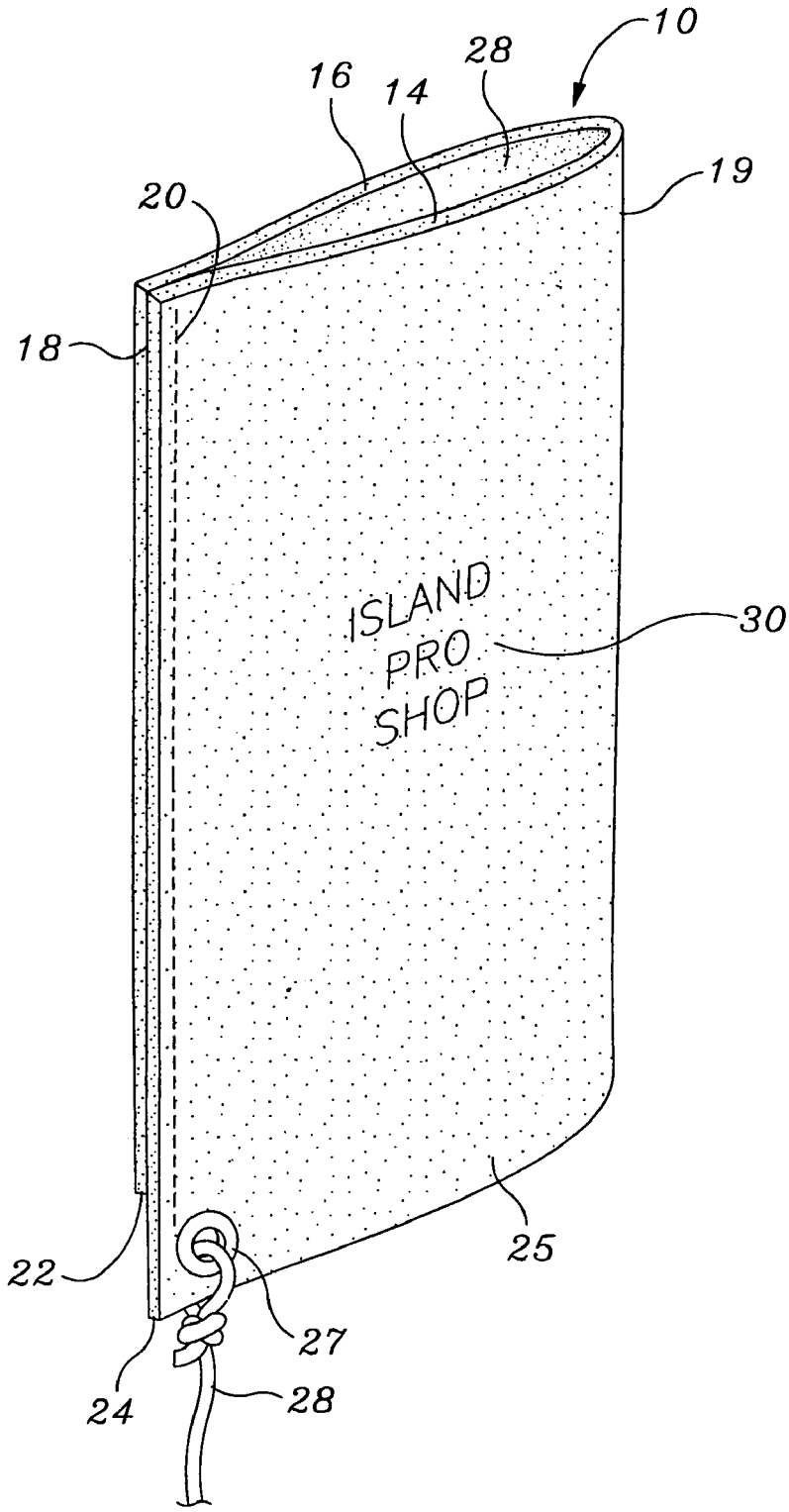
FIG. 1. is a perspective view of the multipurpose cleaning sleeve with flap.

The objects and advantages of the invention will become apparent when the drawings are studied in conjunction with reading the following description and the claims.

DESCRIPTION OF THE PREFERRED EMBODIMENTS

In keeping with the requirements of Patent Laws there is described herein below the best mode of the invention that is currently known to the applicants. For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference now to the drawings, and in particular, to FIGS. 1–5 thereof, the preferred embodiment of the new and improved multi-purpose cleaning sleeve with flap embodying the principles and concepts of the present invention and generally designated by the reference number 10 will be described.

FIG. 1 multi-purpose cleaning sleeve with flap is shown generally shown at 10. The device is made of a soft absorbent material such as terry cloth, or other materials such as muslin, flannel, or cotton, etc. The sleeve is formed by folding a panel of material that has a front panel 14 and a back panel 16 that are fastened together along a first common edge 18. A second common edge 19 is formed by the folded material. Panels can be fastened together by stitching 20 or other fastening means. In this embodiment the back panel has shorter section 22 and front panel has longer section 24 forming a flap 25. Grommet 27 can be used as a suspension means and/or a cord 28 could be used for suspension purposes. Other suspension devices might include snaps, velcro, chains, clips, etc. The cleaning sleeve is open at both ends and has interior 28 and has printing 30 on the flap side of the towel to show how the cleaning sleeve might be used as a promotional device.

An alternate way to make the multi-purpose sleeve with flap might be to make the device out of a rugged absorbent paper material and have the joined edges glued or stitched. The paper multi-purpose cleaning sleeve with flap also could have printing so that it could be used as a promotional item. A paper version could be utilized for a golf tournament, for example, and could be disposed of after the tournament.

The sleeve with the flap on the end makes it extremely easy to insert a golf club head therein because the flap can be easily pushed aside by the club head.

Of course this device could find wide spread use in other applications such as tennis, football, baseball, track, handball, fishing, hunting, bicycling, jogging, household cleaning, hobby use, work shop use, etc. This device is an example of controlled towel use.

Figure 2:
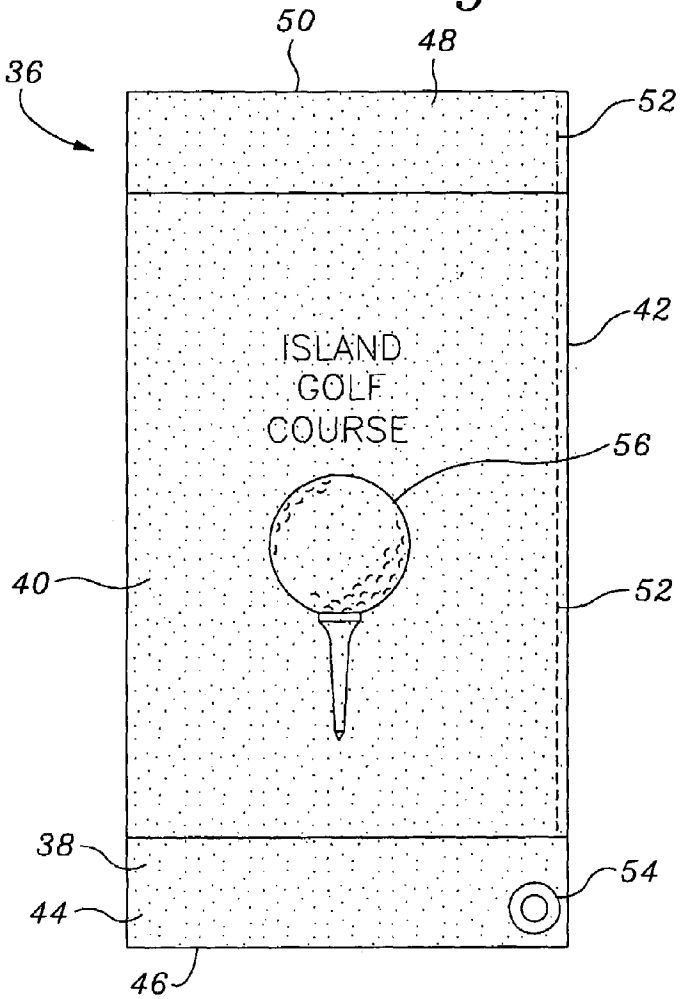
FIG. 2. is an elevation view of the multipurpose cleaning sleeve with flaps on both ends of the sleeve.

FIG. 2 is a front view of an alternate embodiment of the sleeve towel 36 that is formed by folding a panel of material that has a first panel 38 and a second panel 40 that are fastened together along a common edge 42. In this embodiment the sleeve towel has flaps on both ends of the sleeve. A first flap 44 has an end 46. A second flap 48 has an end 50. This embodiment has stitching 52 along the edge to prevent the towel from fraying. Grommet 54 can be used as a suspension means. Advertising and logo 56 can be embroidered or printed on a panel.

Many different colors could be used for the cloth for a new the multi-purpose cleaning sleeve with flap. Also, many colors could be used for any stitching on a new multi-purpose cleaning sleeve with flap.

Additionally, printing and/or embroidering on a new multi-purpose cleaning sleeve with flap could incorporate many colors, designs, etc. Different sizes of towels could be provided for different applications of a new multi-purpose cleaning sleeve with flap.

Also different lengths of flaps could be provided for different applications.

Figure 3:
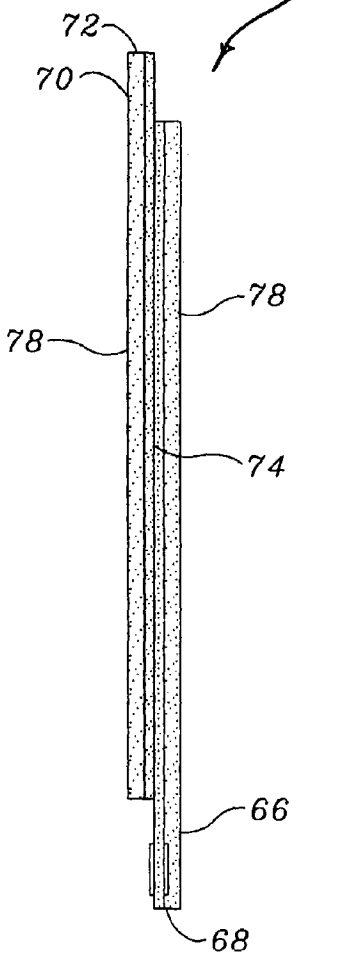
FIG. 3. is a side view of the multipurpose cleaning sleeve with flaps on both ends of the sleeve.

FIG. 3 is a third embodiment of the sleeve towel 62 showing flaps on both ends of the sleeve but on opposite sides. A first flap 66 has an end 68. A second flap 70 has an end 72. This embodiment has "hook & loop" or "velcro" 74 to hold the panels together at common edges 78.

Figure 4:
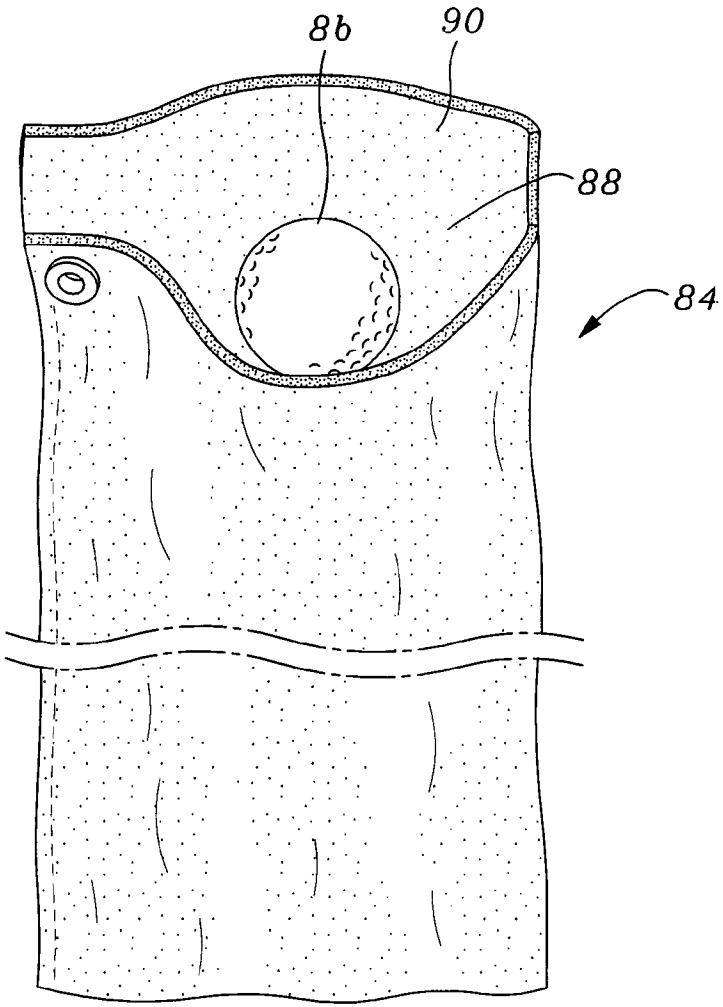
FIG. 4. is an end view of the multipurpose cleaning sleeve with a golf ball inside the sleeve with the flap on the bottom of the sleeve.

FIG. 4. is an end view of sleeve towel 84 showing a golf ball 86 inside the sleeve 88 where it can be cleaned and leaving the grime inside the sleeve. Flap 90 is on the end of sleeve towel 84. This view shows how other items, such as a golf club head, would be placed inside the sleeve for cleaning.

Figure 5:
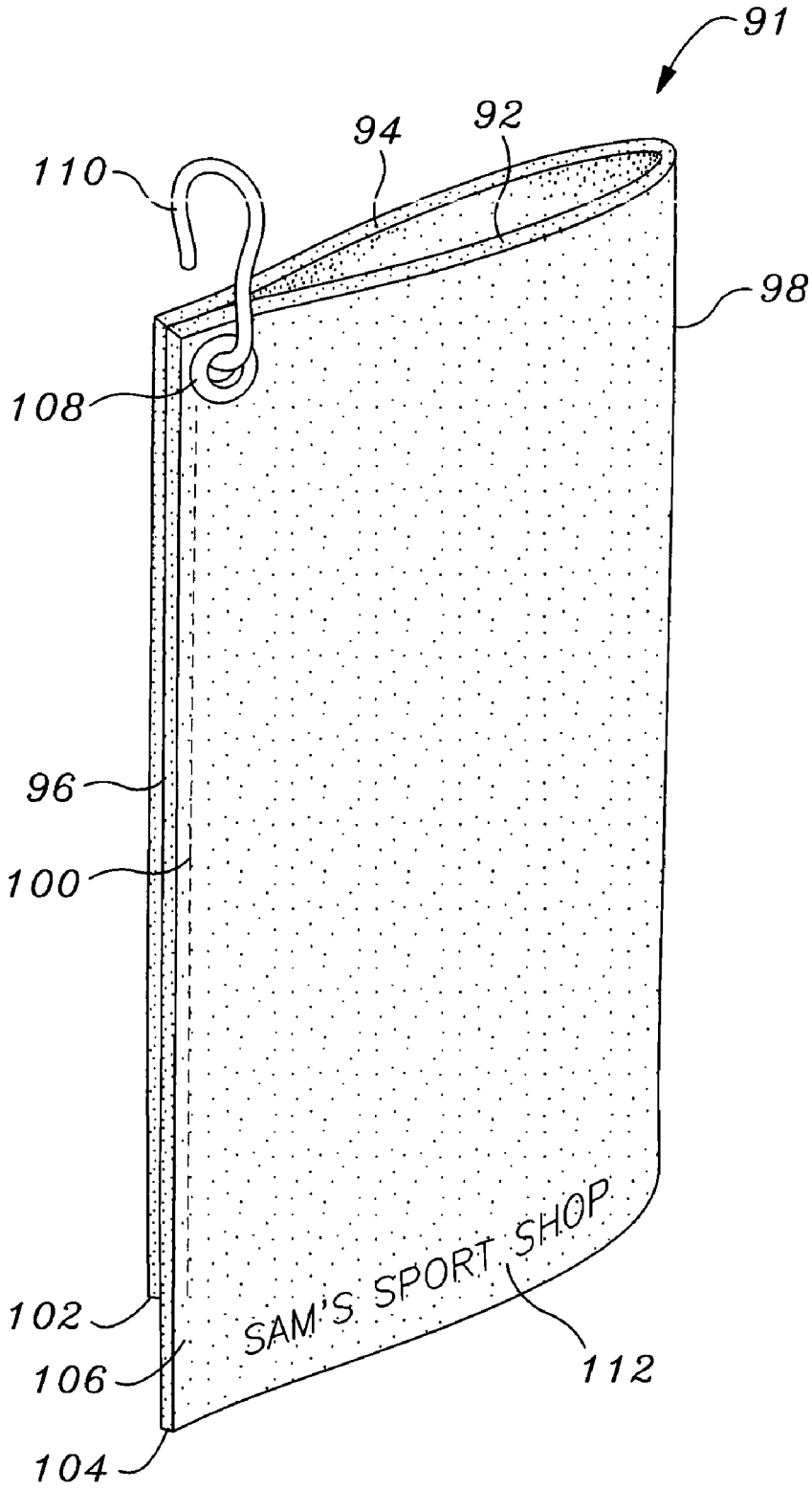
FIG. 5. is a perspective view of the multipurpose cleaning sleeve with flap along with a hanging device and printing on the flap.

FIG. 5 is another multi-purpose cleaning sleeve with flap is shown generally at 91 is formed by folding a panel of material that has a front panel 92 and a back panel 94 that are fastened together along a first common edge 96. A second common edge 98 is formed by the folded material. Panels can be fastened together by stitching 100. In this embodiment the back panel has shorter section 102 and front panel has longer section 104 forming a flap 106. Grommet 108 has a hook 110 that can be used as a suspension means for example to hang the sleeve towel from a belt. Printing 112 on the outside of flap 106 of the towel to show how the cleaning sleeve might be used as a promotional device.

Making the device of a washable material could make it easy to keep clean and reusable. A paper version could be disposable, or reusable.

It should be very clear from the drawings and the above description that this new multi-purpose cleaning sleeve with flap is unique and clearly provides a simple solution that the prior art does not provide.

Another attractive aspect device is that it is simple in design, and would be inexpensive to manufacture. Therefore, it could be sold to consumers for a relatively low price, making it affordable to almost anyone. Therefore it should find wide spread use in the marketplace.

This invention having been described in its presently contemplated best mode, it is clear that it is susceptible to numerous, variations, modifications, modes and embodiments within the ability of those skilled in the art and without departing from the true spirit and scope of the novel concepts or principles of this invention. Also, it is to be understood that the phraseology and terminology employed herein are for the purpose of description and should not be regarded as limiting. It should be understood that the preferred embodiment has been shown and described and that all changes and modifications that come within the spirit of the invention are desired to be protected. The invention is capable of other embodiments and of being practiced and carried out in various ways. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Accordingly, the scope of the invention is defined by the scope of the following claims.

What is claimed as new and desired to be secured by United States Letters Patent is:

1. A cleaning device or a sports related towel comprising:

a cleaning device having the shape of a flat sleeve; said cleaning device being formed from a single piece of material that is folded and includes a folded edge; said material being permanently fastened opposite said folded edge to form said sleeve; said cleaning device having an inner surface and an outer surface; said cleaning device being made of an absorbent material; said cleaning device having a first open end and a second open end; said first open end of said cleaning device configured to form a flap; said flap being an extended section of material that is longer than an adjacent section of said first open end of said cleaning device.

2. The cleaning device or sports related towel of claim 1 wherein said device is made from fabric substantially similar to terry cloth.

3. The cleaning device or sports related towel of claim 1 wherein said device is made from an absorbent paper material.

4. The cleaning device or sports related towel of claim 1 wherein said device has printing or embroidering thereon.

5. The cleaning device or sports related towel of claim 1 wherein said device has advertising or promotional material thereon.

6. The cleaning device or sports related towel of claim 1 wherein said device has a suspension device incorporated thereon.

7. The cleaning device or sports related towel of claim 1 wherein said device has a hook or a grommet, or a cord incorporated thereon.

8. The cleaning device or sports related towel of claim 1 wherein said cleaning device has substantially parallel sides.

9. The cleaning device or sports related towel of claim 1 wherein second open end of said cleaning device is configured to form a flap; said flap being an extended section of material that is longer than an adjacent section of said second open end of said cleaning device.

10. A cleaning device or a sports related towel comprising:

a cleaning device having the shape of a flat sleeve; said cleaning device being formed from a single piece of material that is folded and includes a folded edge; said material being permanently fastened opposite said folded edge to form said sleeve; said cleaning device having an inner surface and an outer surface; said cleaning device being made of an absorbent material; said cleaning device having a first open end and a second open end; said first open end of said cleaning device configured to form a flap; said flap being an extended section of material that is longer than an adjacent section of said first open end of said cleaning device;

said second open end of said cleaning device configured to form a flap; said flap being an extended section of material that is longer than an adjacent section of said second open end of said cleaning device.

11. The cleaning device or sports related towel of claim 10 wherein said device is made from a material that is substantially similar to terry cloth fabric.

12. The cleaning device or sports related towel of claim 10 wherein said device is made from an absorbent paper material.

13. The cleaning device or sports related towel of claim 10 wherein said device has printing or embroidering thereon.

14. The cleaning device or sports related towel of claim 10 wherein said device has advertising or promotional material thereon.

15. The cleaning device or sports related towel of claim 10 wherein said device has a hook or a grommet, or a cord, or a suspension device incorporated thereon.

16. The cleaning device or sports related towel of claim 10 wherein said device has substantially parallel sides.

17. A cleaning device or a sports related towel comprising:

cleaning device having the shape of a flat sleeve; said cleaning device being formed from a single piece of material that is folded and includes a folded edge; said material being permanently fastened opposite said folded edge to form said sleeve; said cleaning device having an inner surface and an outer surface; said cleaning device being made of an absorbent material; said cleaning device having a first open end; and a second open end;

said first open end of said cleaning device configured to form a flap; said flap being an extended section of material that is longer than an adjacent section of said first open end of said cleaning device; said second open end of said cleaning device configured to form a flap; said flap being an extended section of material that is longer than an adjacent section of said second open end of said cleaning device; said cleaning device having advertising or promotional material thereon.

18. The cleaning device or sports related towel of claim 17 wherein said device is made from a material that is substantially similar to terry cloth fabric.

19. The cleaning device or sports related towel of claim 17 wherein said device is made from an absorbent paper material.

20. The cleaning device or sports related towel of claim 17 wherein said device has printing or embroidering thereon.

21. The cleaning device or sports related towel of claim 17 wherein said device has a hook or a grommet, or a cord, or a suspension device incorporated thereon.

* * * * *